US006275139B1

(12) United States Patent
Shimomura et al.

(10) Patent No.: US 6,275,139 B1
(45) Date of Patent: Aug. 14, 2001

(54) MULTIDIRECTIONAL INPUT DEVICE

(75) Inventors: Hisato Shimomura; Seiji Aizawa, both of Miyagi-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 0 days.

(21) Appl. No.: 09/556,024

(22) Filed: Apr. 20, 2000

(30) Foreign Application Priority Data

Apr. 22, 1999 (JP) ..... 11-114913

(51) Int. Cl.[7] ..... H01C 10/16

(52) U.S. Cl. ..... 338/128; 338/129; 338/130; 200/6 A; 273/148 B

(58) Field of Search ..... 338/128, 129, 338/130, 131; 273/148 B; 200/6 A

(56) References Cited

U.S. PATENT DOCUMENTS

| | | | | |
|---|---|---|---|---|
| 3,308,675 | * | 3/1967 | Jonsoon | 338/128 |
| 3,394,611 | * | 7/1968 | Beurrier | 338/128 |
| 3,918,021 | * | 11/1975 | Nishioka et al. | 338/128 |
| 4,439,648 | * | 3/1984 | Reiner et al. | 200/6 A |
| 4,469,330 | * | 9/1984 | Asher | 273/148 B |
| 4,590,454 | * | 5/1986 | Zettergren | 338/128 |
| 4,620,176 | * | 10/1986 | Hayes | 338/128 |
| 4,689,449 | * | 8/1987 | Rosen | 200/6 A |
| 4,912,997 | * | 4/1990 | Malcolm et al. | 338/128 |
| 5,176,041 | * | 1/1993 | Meier et al. | 338/128 |
| 5,229,742 | | 7/1993 | Miyamoto et al. . | |
| 6,078,247 | * | 6/2000 | Shimomura | 338/128 |

FOREIGN PATENT DOCUMENTS 4-36618 4/1992 (JP) .

* cited by examiner

*Primary Examiner*—Karl D. Easthom
(74) *Attorney, Agent, or Firm*—Brinks Hofer Gilson & Lione

(57) ABSTRACT

In a multidirectional input device, a surface of a bottom plate facing the bottom of an operating member is provided with a projection having a taper portion that gradually rises from the outer periphery toward the center, wherein the operating member is tilted with the tilting operation of a control shaft and contacts the projection to regulate the motion of the operating member. Therefore, the operating member does not slip, and a tactile feel is not produced in the tilting operation.

5 Claims, 15 Drawing Sheets

MULTIDIRECTIONAL INPUT DEVICE

BACKGROUND OF THE INVENTION

1. Field of the Invention

The present invention relates to a multidirectional input device, and more particularly, to a multidirectional input device in which a plurality of electric parts can be simultaneously operated by manipulating a control shaft.

2. Description of the Related Art

The present inventors disclose a multidirectional input device in U.S. patent application Ser. Nos. 09/332753 and 09/333276. In the disclosed conventional multidirectional input device (as shown in FIGS. 14 to 20), a first interlock member 32 having a slot 32*a* is turnably mounted in a cavity of a box-shaped frame 31. The first interlock member 32 is turned to change the resistance of a variable resistor 33 mounted on the frame 31.

A control shaft 34 has a shaft support portion 34*b* formed at the center and a pair of shaft portions 34*a* disposed in a direction orthogonal to the axis of the shaft support portion 34*b*. The control shaft 34 is passed through the slot 32*a* of the first interlock member 32 so as to be movable along the slot 32*a*.

The shaft portions 34*a* are turnably supported by a second interlock member 35, thereby allowing the control shaft 34 to be tilted in the A—A direction.

The second interlock member 35 is made of synthetic resin, and is placed below the first interlock member 32 and is orthogonal thereto.

The second interlock member 35 comprises a rectangular side wall 35*b* having a center opening 35*a* for passing the control shaft 34 therethrough, a pair of circular holes 35*c* formed in the opposing sides of the side wall 35*b* so as to be engaged with the shaft portions 34*a* of the control shaft 34, and part operating portions 35*d* and 35*e* protruding outward from the side wall 35*b*.

The shaft portions 34*a* of the control shaft 34 are snap-fitted in the circular holes 35*c*, and the control shaft 34 is thereby held by the second interlock member 35.

The second interlock member 35 is turnably supported by the frame 31 to allow the control shaft 34 to be tilted in the B—B direction. A variable resistor 36 mounted on the frame 31 is controlled by the part operating portion 35*d*, and a pushbutton switch 37 mounted on the frame 31 is operated by the part operating portion 35*e*.

At the shaft support portion 34*b* in the lower part of the control shaft 34 placed in the frame 31, an operating member 38 is disposed to move in the axial direction of the control shaft 34.

The operating member 38 is made of resin, and has a base portion 38*a* having a lower surface curved like a saucer. A cylindrical boss portion 38*b* projects upward from the center of the base portion 38*a*, and a shaft hole 38*c* penetrates through the center of the boss portion 38*b*.

The shaft support portion 34*b* of the control shaft 34 is fitted in the boss portion 38*b* of the operating member 38 so that the operating member 38 can move in the axial direction of the shaft support portion 34*b*.

An urging member 39 formed of a coil spring is interposed between the control shaft 34 and the operating member 38.

A bottom plate 40 is placed under the operating member 38 so as to close the bottom of the frame 31. The bottom of the operating member 38 is elastically contacted with the flat inner bottom face of the bottom plate 40 by the urging member 39.

The operation of the conventional multidirectional input device will now be described. When operating force is not applied to the control shaft 34 (i.e., when no load is imposed), the operating member 38 is elastically contacted with the inner bottom face of the bottom plate 40 by the elastic force of the urging member 39, the saucerlike bottom face of the base portion 38*a* is in the horizontal position, and the control shaft 34 is in the neutral upright position (as shown in FIGS. 15 and 17).

When the control shaft 34 is tilted along the slot 32*a* of the first interlock member 32 in the direction B—B (see FIGS. 15 and 17), the second interlock member 35 turns on the mounting positions on the frame 31, and the operating member 38 is brought into the states shown in FIGS. 19 and 20 and is tilted while the bottom face of the base portion 38*a* moves in sliding contact with the inner bottom face of the bottom plate 40. This causes the boss portion 38*b* of the operating member 38 is pushed into the control shaft 34 against the elastic force of the urging member 39.

In the neutral state shown in FIG. 17, clearances K1 and K2 serve as play on the right and left sides of the control shaft 34 between the control shaft 34 and the second interlock member 35 because of the connecting structure therebetween.

As shown in FIG. 18, when the control shaft 34 is initially tilted, the clearance K1 on the tilting side is lost, and the clearance K2 on the opposite side increases.

When the tilting operation is continued in this state, the operating member 31 is brought into a state shown in FIG. 19, and then, into a state shown in FIG. 20 in which it is tilted at a predetermined angle.

When the operating member 38 is tilted by a greater angle than a certain angle, the force in the surface direction of the bottom plate 40 by the spring force of the urging member 39 exceeds the friction force between the operating member 38 and the bottom plate 40 between the states shown in FIGS. 19 and 20. The operating member 38 consequently slides in the direction of the arrow D, and the clearance shifts from the clearance K2 to the clearance K1. This shift operation is transmitted as a tactile feel to the control shaft 34, which impairs operability.

When the second interlock member 35 is turned, the resistance of the variable resistor 36 is changed by the part operating portion 35*d*. When the operating force applied to the control shaft 34 is removed after the operation of the variable resistor 36 is completed, the operating member 38 automatically returns to the horizontal position because of the elastic force of the urging member 39, and the control shaft 34 also automatically returns to the neutral position.

When the control shaft 34 is tilted along the center opening 35*a* of the second interlock member 35 in the direction A—A in FIG. 16, the first interlock member 32 is turned to adjust the variable resistor 33.

Description will now be given of the operation of the pushbutton switch 37 serving as an electric part in addition to the variable resistors 33 and 36. First, the control shaft 34 is pressed down in the direction of the arrow C, as shown in FIG. 16.

Then, the second interlock member 35 is moved down because of pressure, and the part operating portion 35*e* presses a stem portion of the pushbutton switch 37 to turn the pushbutton switch 37 on and off.

When the control shaft 34 is released from pressing, it is returned to the initial state by the urging member 38.

The control shaft 34 may be pressed in the direction of the arrow C not only in the neutral position, but also when it is tilted to control the resistances of the variable resistors 33 and 36.

When the control shaft 34 is tilted in the conventional multidirectional input device, the bottom of the operating member 38 moves in sliding contact with the inner bottom face of the bottom plate 40. Therefore, when the operating member 38 is tilted at a greater angle than a certain angle, it slips in the direction of the arrow D, and this slip is transmitted as a tactile feel to the control shaft 34, which impairs operability.

SUMMARY OF THE INVENTION

Accordingly, it is an object of the present invention to provide a multidirectional input device with a superior operability in which tactile feel is not produced in a tilting operation of a control shaft.

According to a first arrangement for overcoming the above problems, there is provided a multidirectional input device including: a frame; first and second interlock members turnably mounted in the frame so as to intersect each other; a control shaft placed perpendicularly to the first and second interlock members and held by the second interlock member so as to be tilted to turn the first and second interlock members; a bottom plate placed so as to intersect the axial direction of the control shaft; an operating member held by the control shaft to move in the axial direction of the control shaft; an urging member for elastically pressing the bottom of the operating member against the bottom plate; and electric parts operated via the first and second interlock members by the tilting of the control shaft, wherein a surface of the bottom plate facing the bottom of the operating member is provided with a projection having a taper portion that gradually rises from the outer periphery toward the center, and the operating member tilted with the tilting operation of the control shaft contacts the projection to regulate the motion of the operating member.

According to a second preferred arrangement, the projection has at least the taper portion in the forming direction of the first interlock member.

According to a third preferred arrangement, the taper portion of the projection is conical.

According to a fourth preferred arrangement, the operating member has a recess on a surface facing the bottom plate, and the projection is placed in the recess.

According to a fifth preferred arrangement, the operating member has an arc-shaped face portion on the outer periphery facing the bottom plate, and the arc-shaped face portion is in contact with the taper portion of the projection.

Further objects, features, and advantages of the present invention will become apparent from the following description of the preferred embodiments with reference to the attached drawings.

DESCRIPTION OF THE PREFERRED EMBODIMENT

Figure 1:
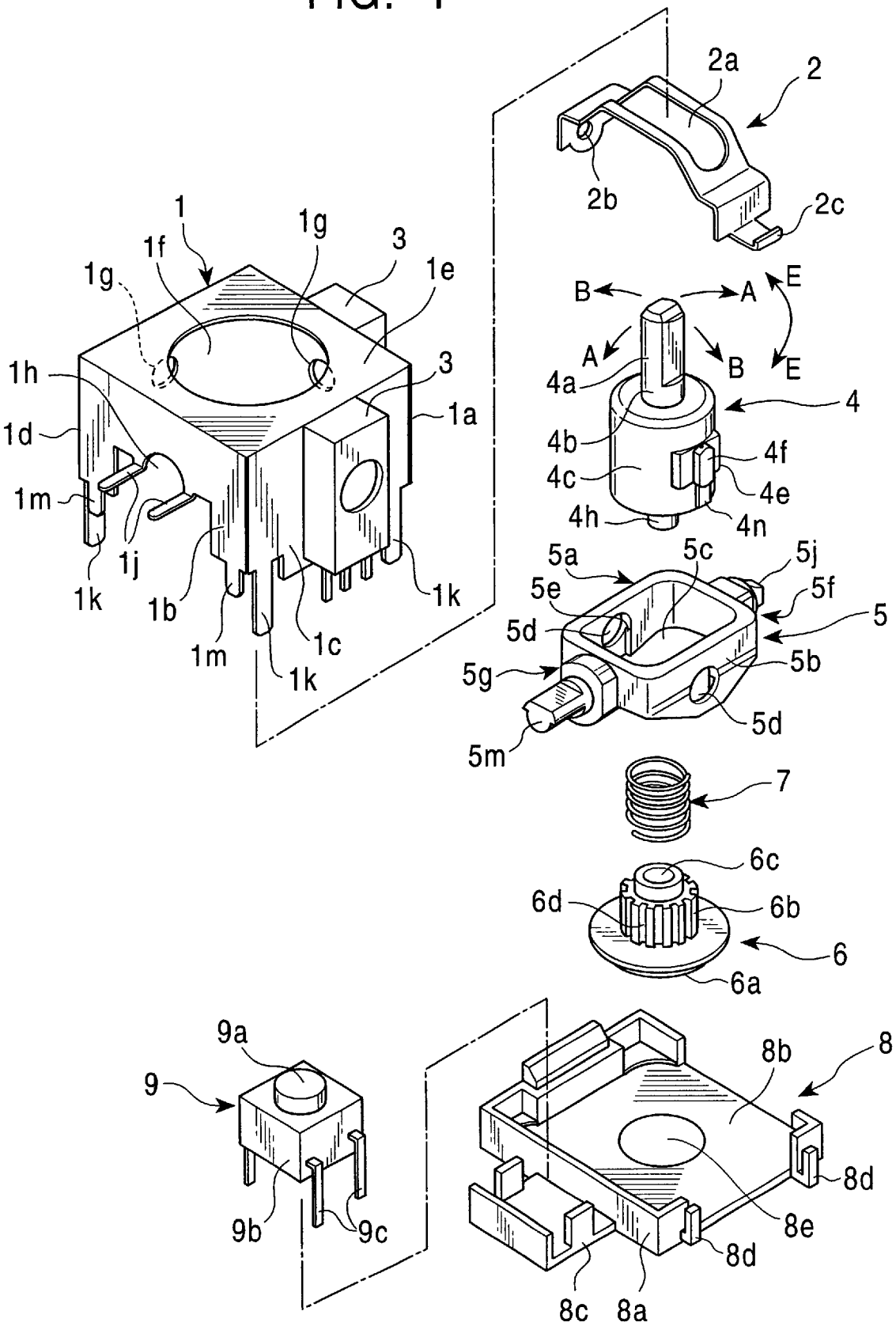
FIG. 1 is an exploded perspective view of a multidirectional input device according to the present invention.
Figure 5:
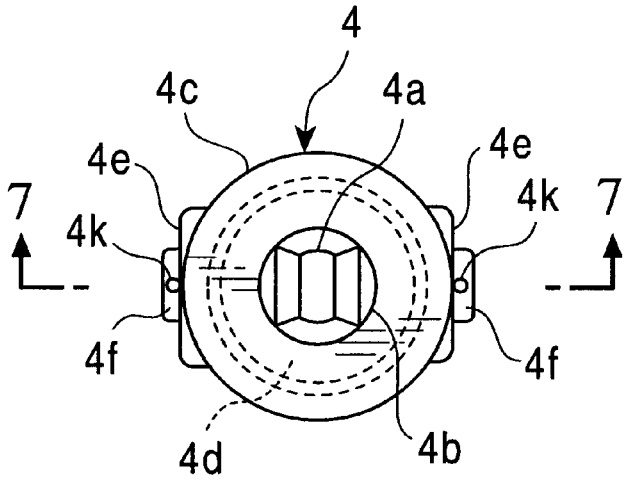
FIG. 5 is a top view of a control shaft for use in the multidirectional input device of the present invention.
Figure 6:
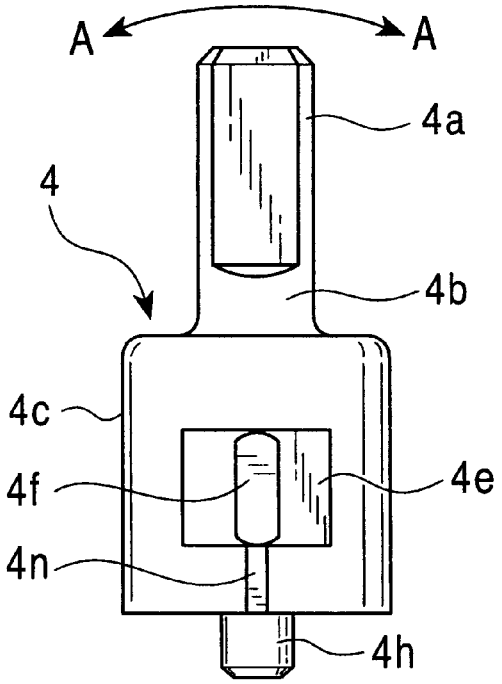
FIG. 6 is a front view of the control shaft.
Figure 7:
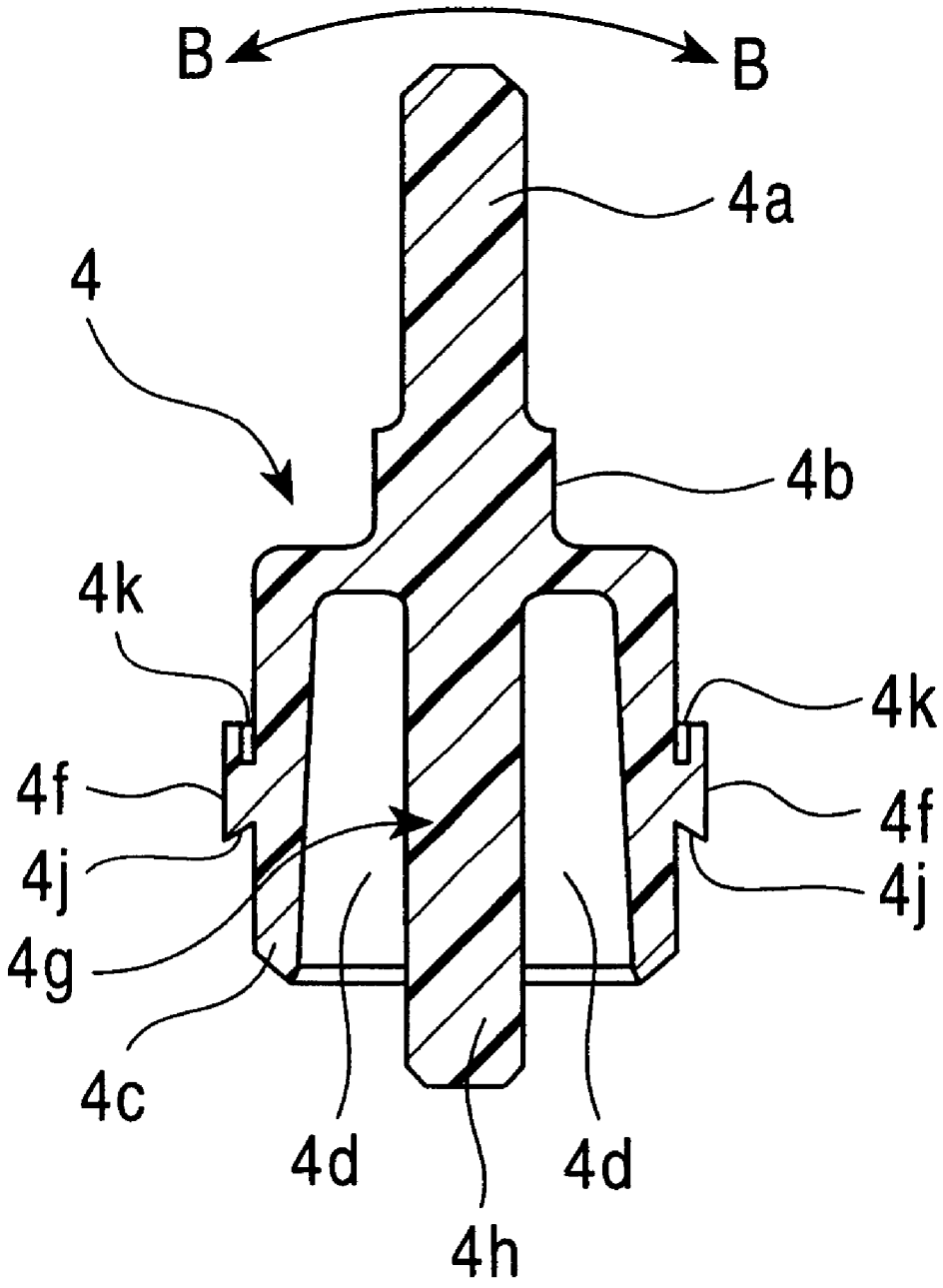
FIG. 7 is a cross-sectional view of the control shaft taken along line 7—7 in FIG. 5.
Figure 8:
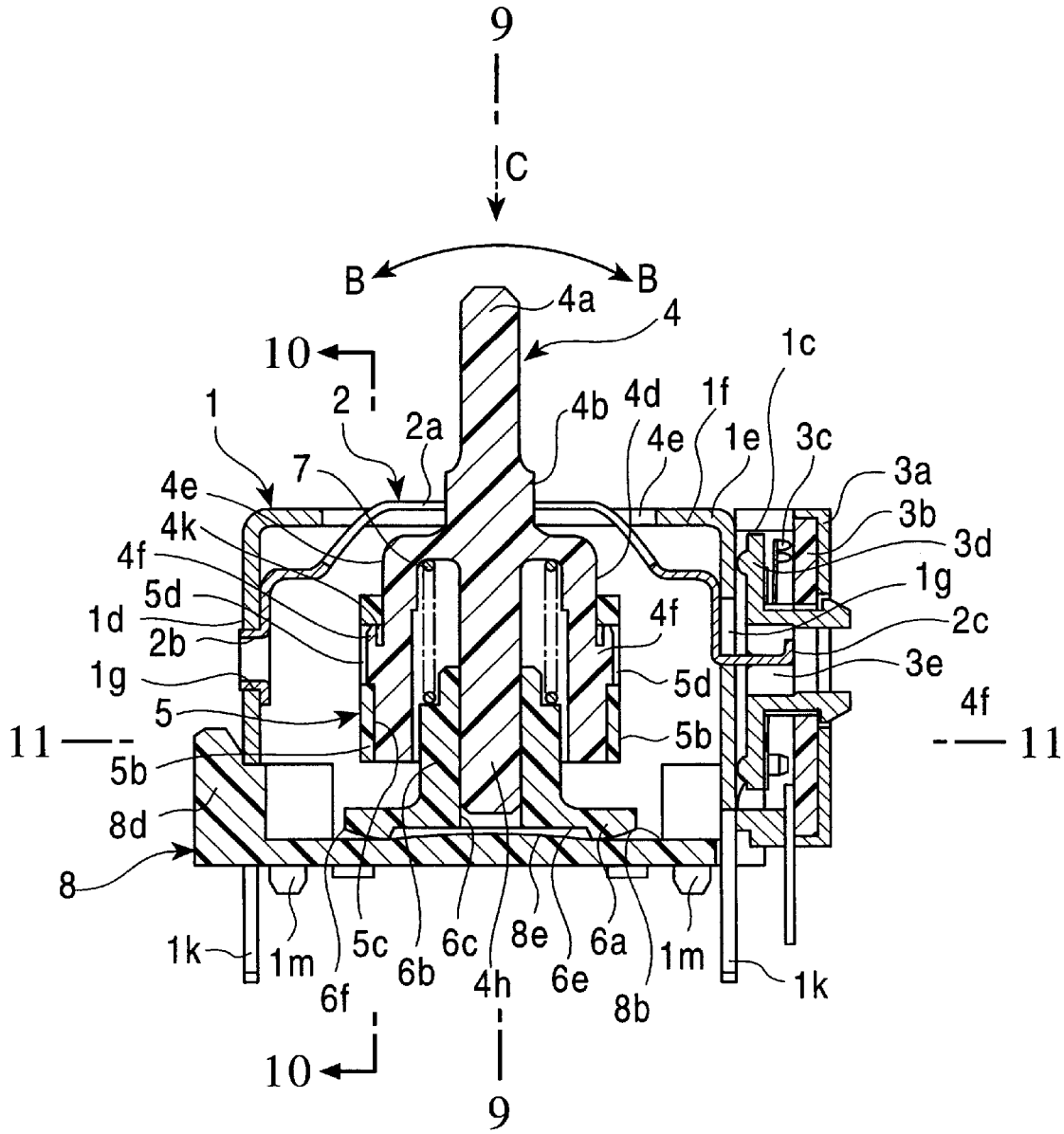
FIG. 8 is a longitudinal sectional view of the principal part of the multidirectional input device.
Figure 9:
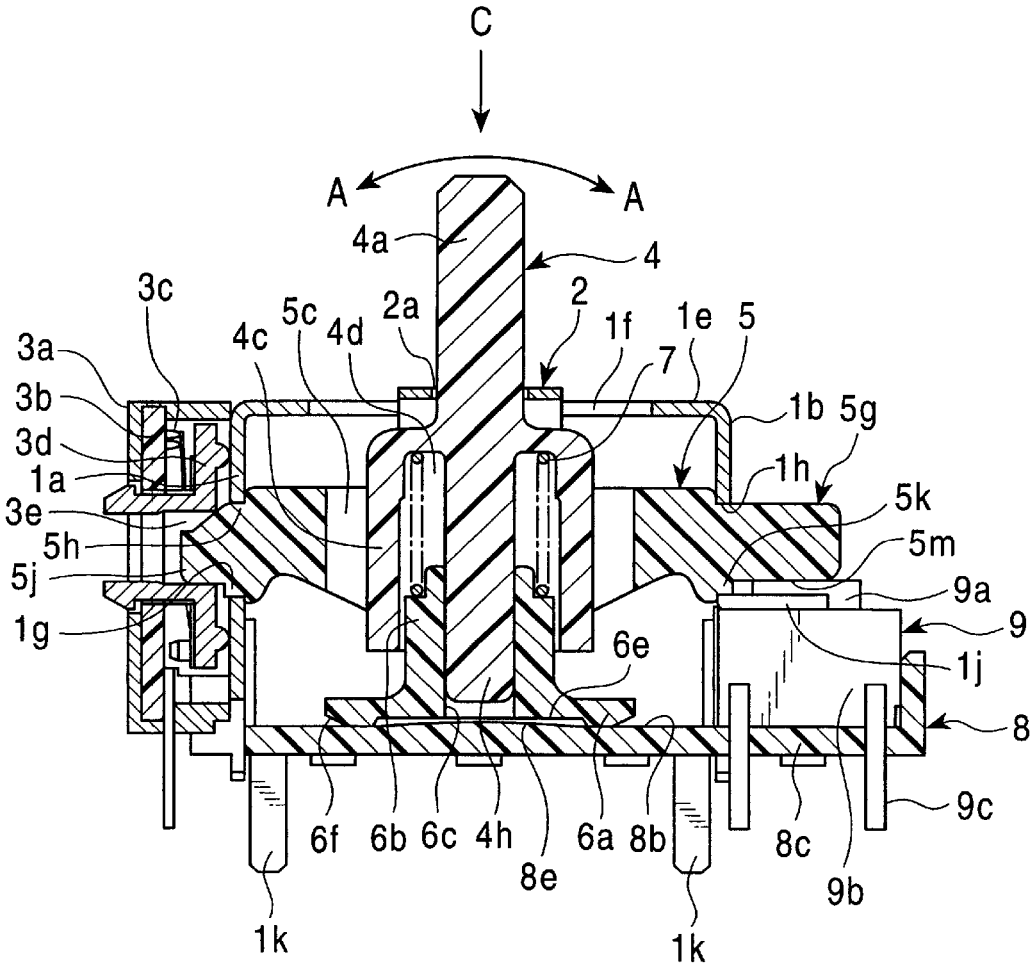
FIG. 9 is a sectional view of the multidirectional input device taken along line 9—9 in FIG. 8.
Figure 10:
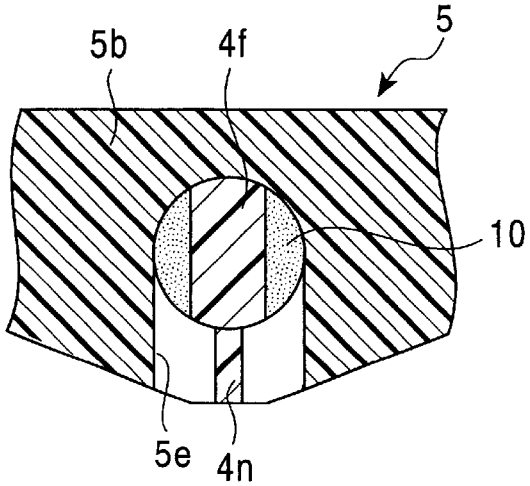
FIG. 10 is a sectional view of the principal part of the multidirectional input device taken along line 10—10 in FIG. 8.
Figure 11:
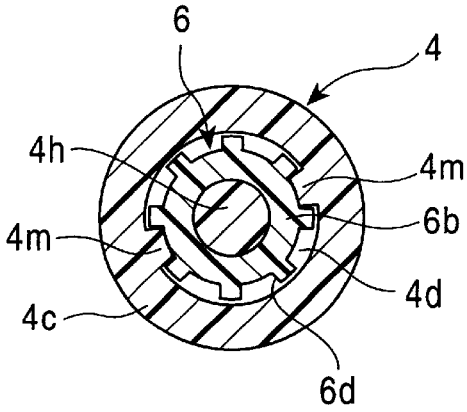
FIG. 11 is a sectional view of the principal part of the multidirectional input device taken along line 11—11 in FIG. 8.
Figure 12:
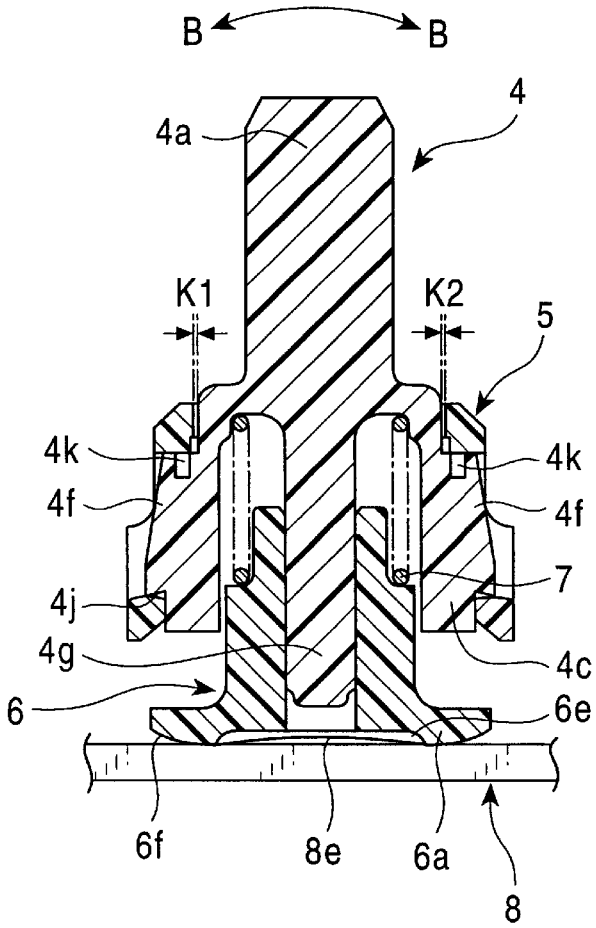
FIG. 12 is an explanatory view showing the operation of the multidirectional input device of the present invention.
Figure 13:
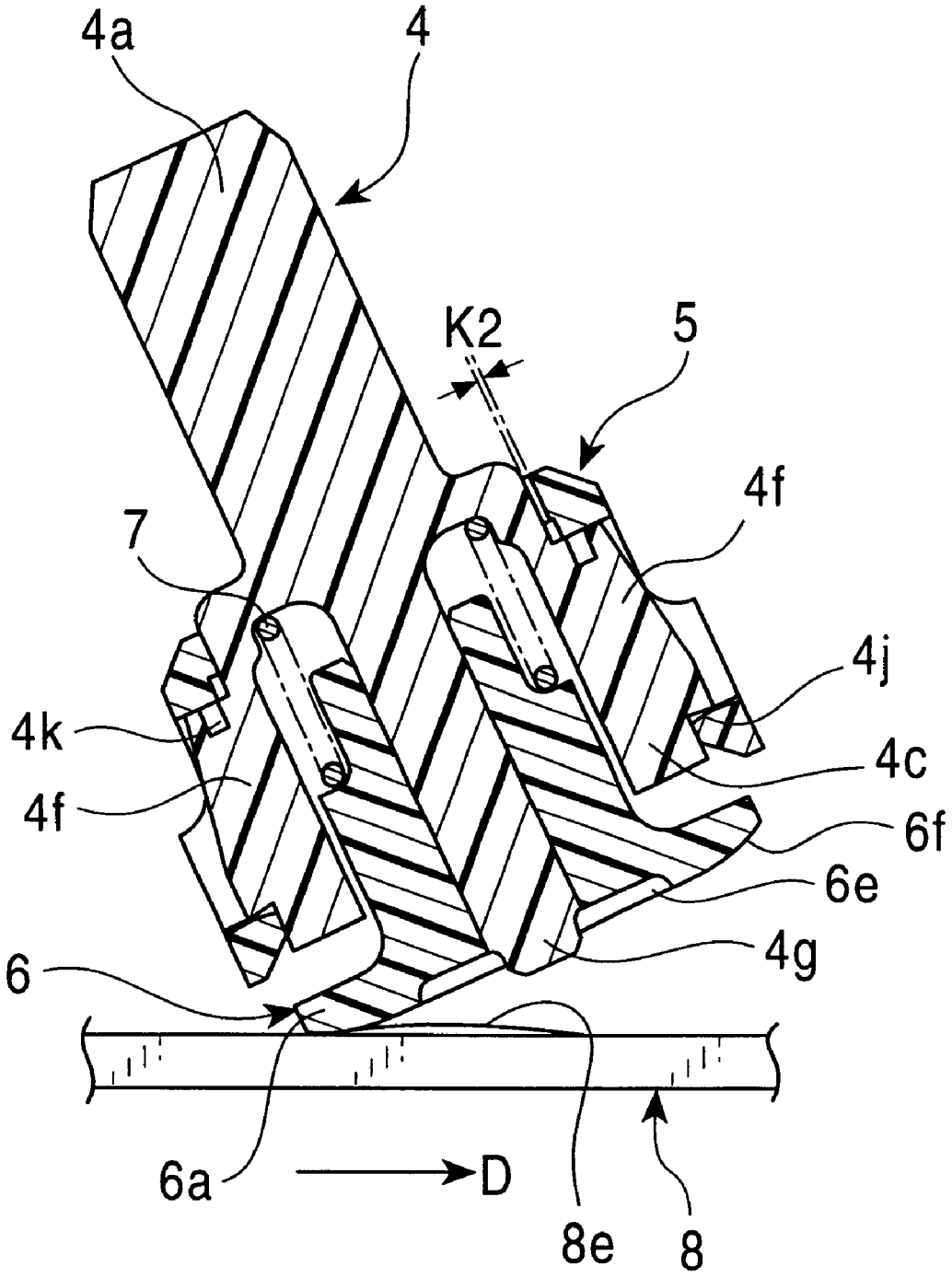
FIG. 13 is an explanatory view showing the operation of the multidirectional input device.
Figure 14:
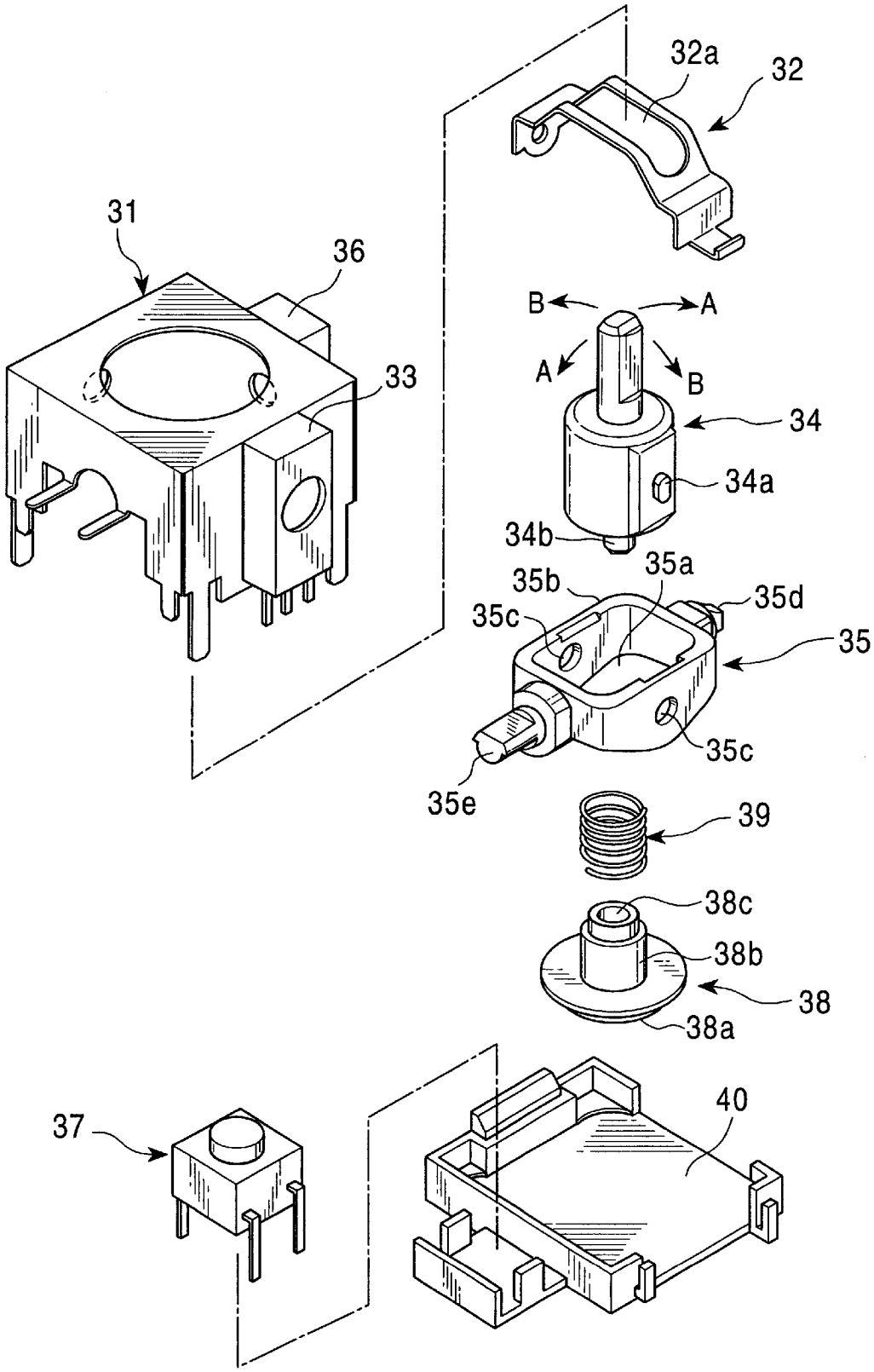
FIG. 14 PRIOR ART
FIG. 14 is an exploded perspective view of a conventional multidirectional input device.
Figure 15:
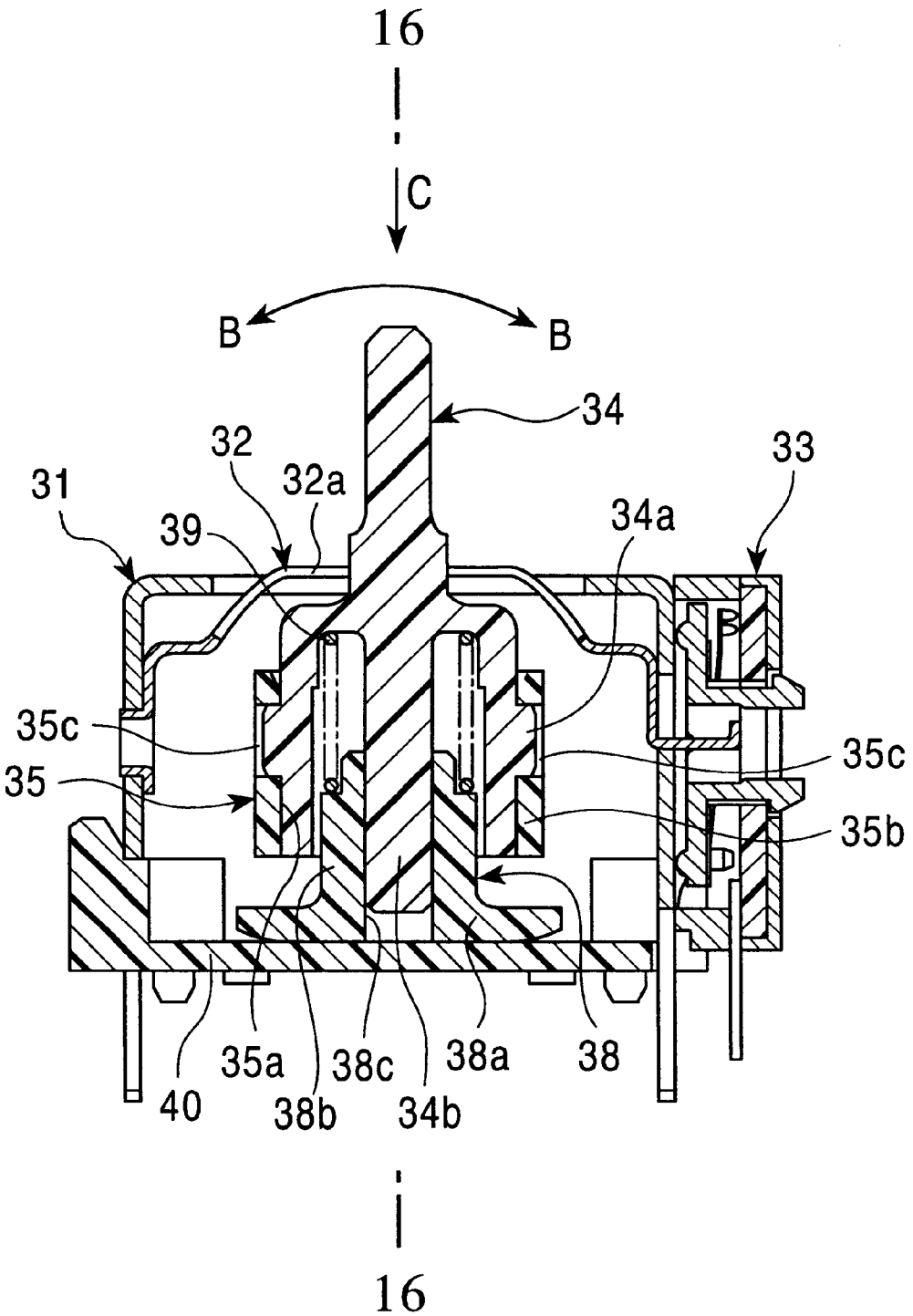
FIG. 15 PRIOR ART
FIG. 15 is a cross-sectional view of a principal part of the conventional multidirectional input device.
Figure 16:
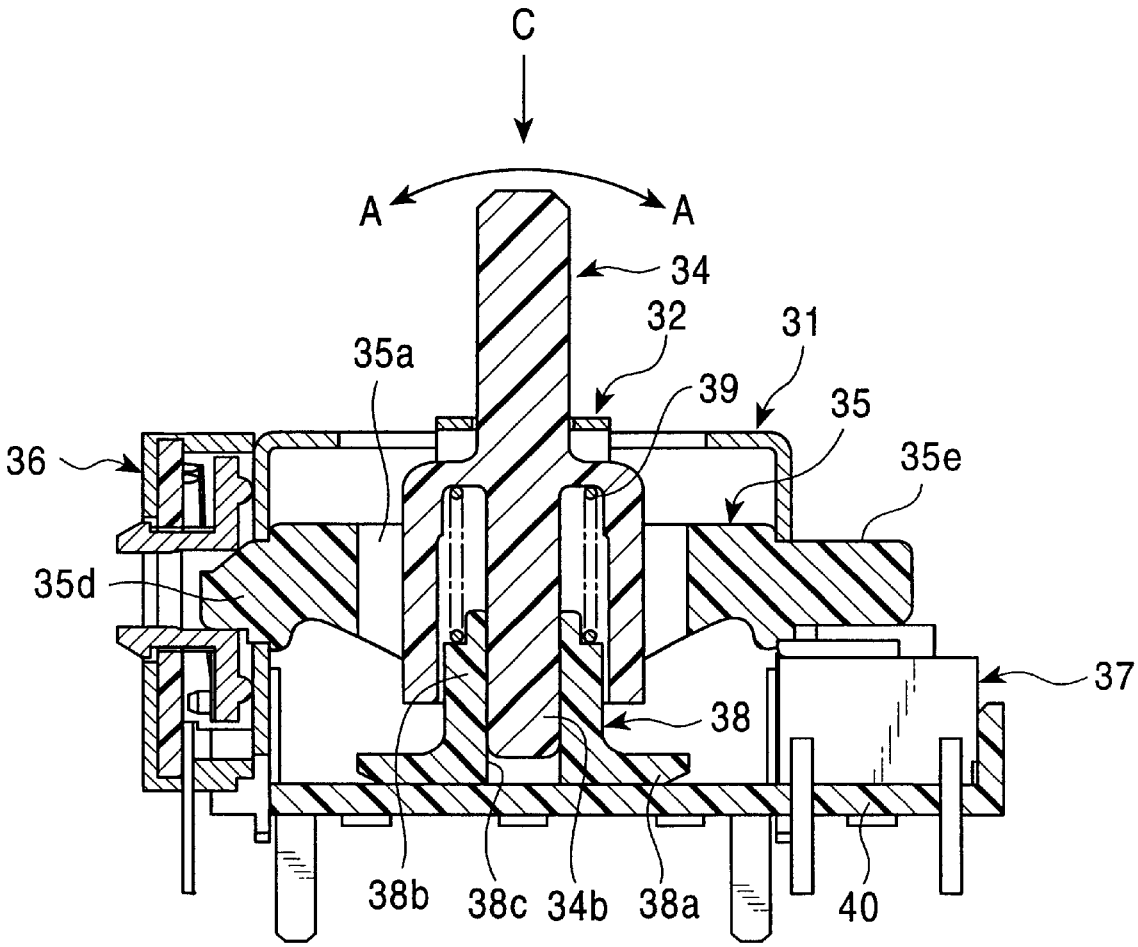
FIG. 16 PRIOR ART
FIG. 16 is a sectional view taken along line 16—16 in FIG. 15.
Figure 17:
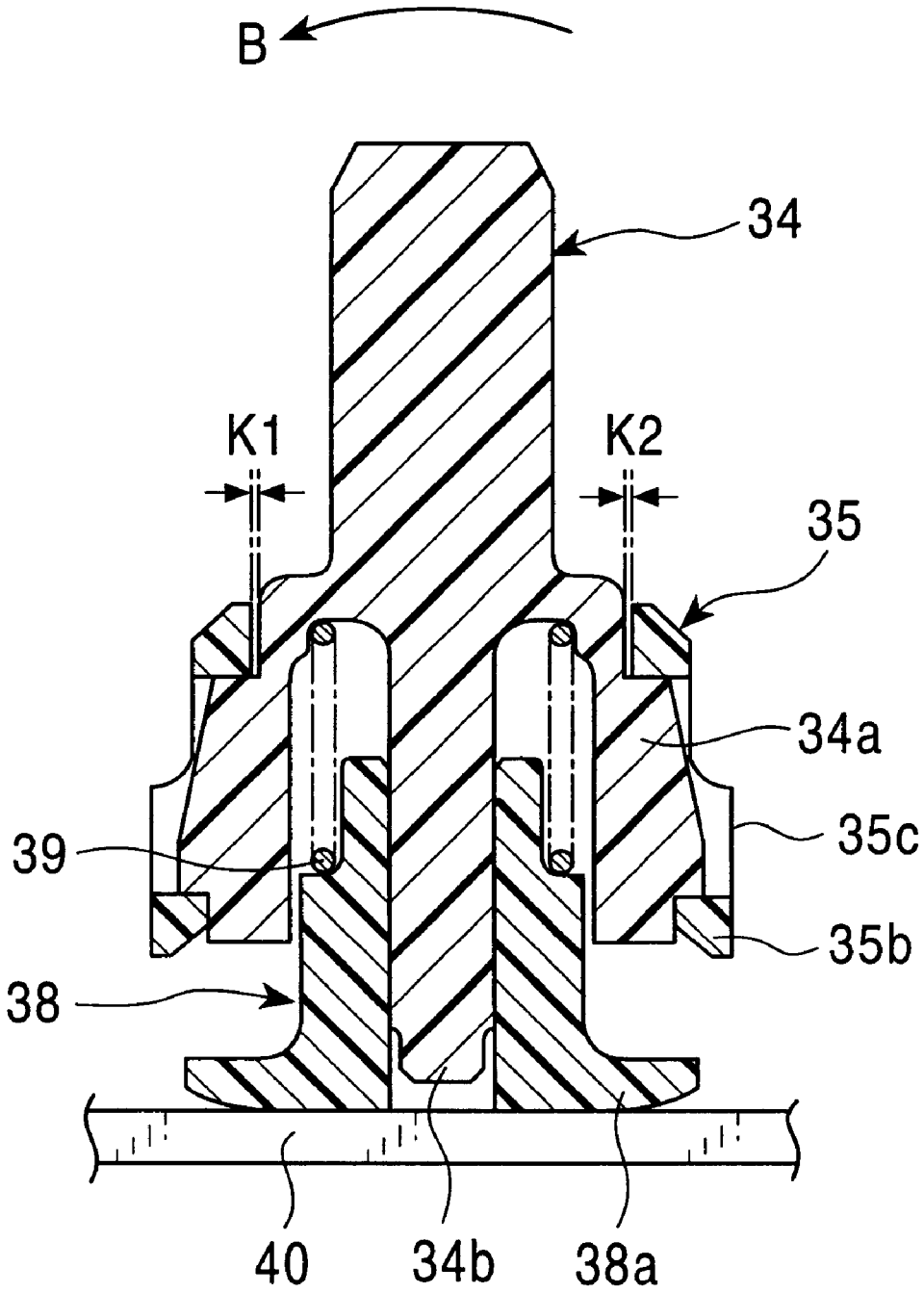
FIG. 17 PRIOR ART
FIG. 17 is an explanatory view showing the operation of the conventional multidirectional input device.
Figure 18:
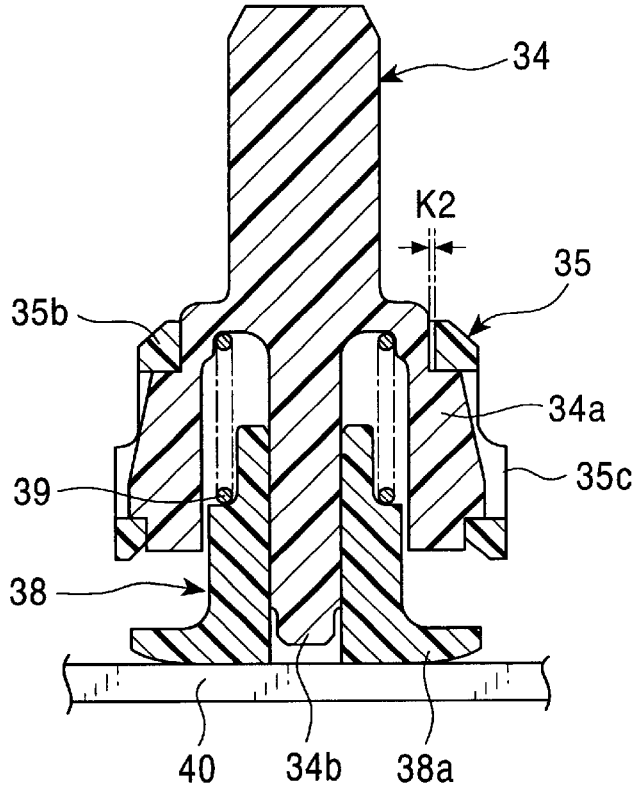
FIG. 18 PRIOR ART
FIG. 18 is an explanatory view showing the operation of the conventional multidirectional input device.
Figure 19:
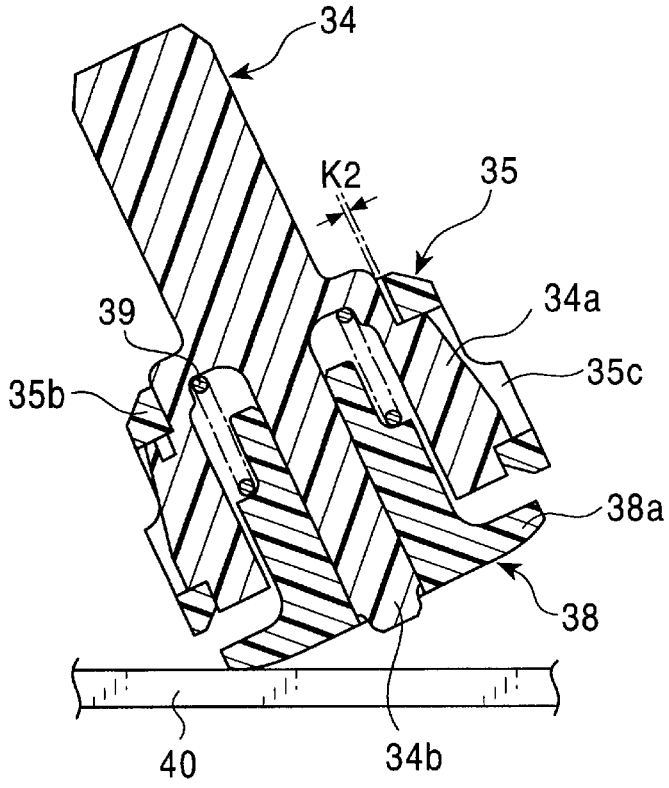
FIG. 19 PRIOR ART
FIG. 19 is an explanatory view showing the operation of the conventional multidirectional input device.
Figure 20:
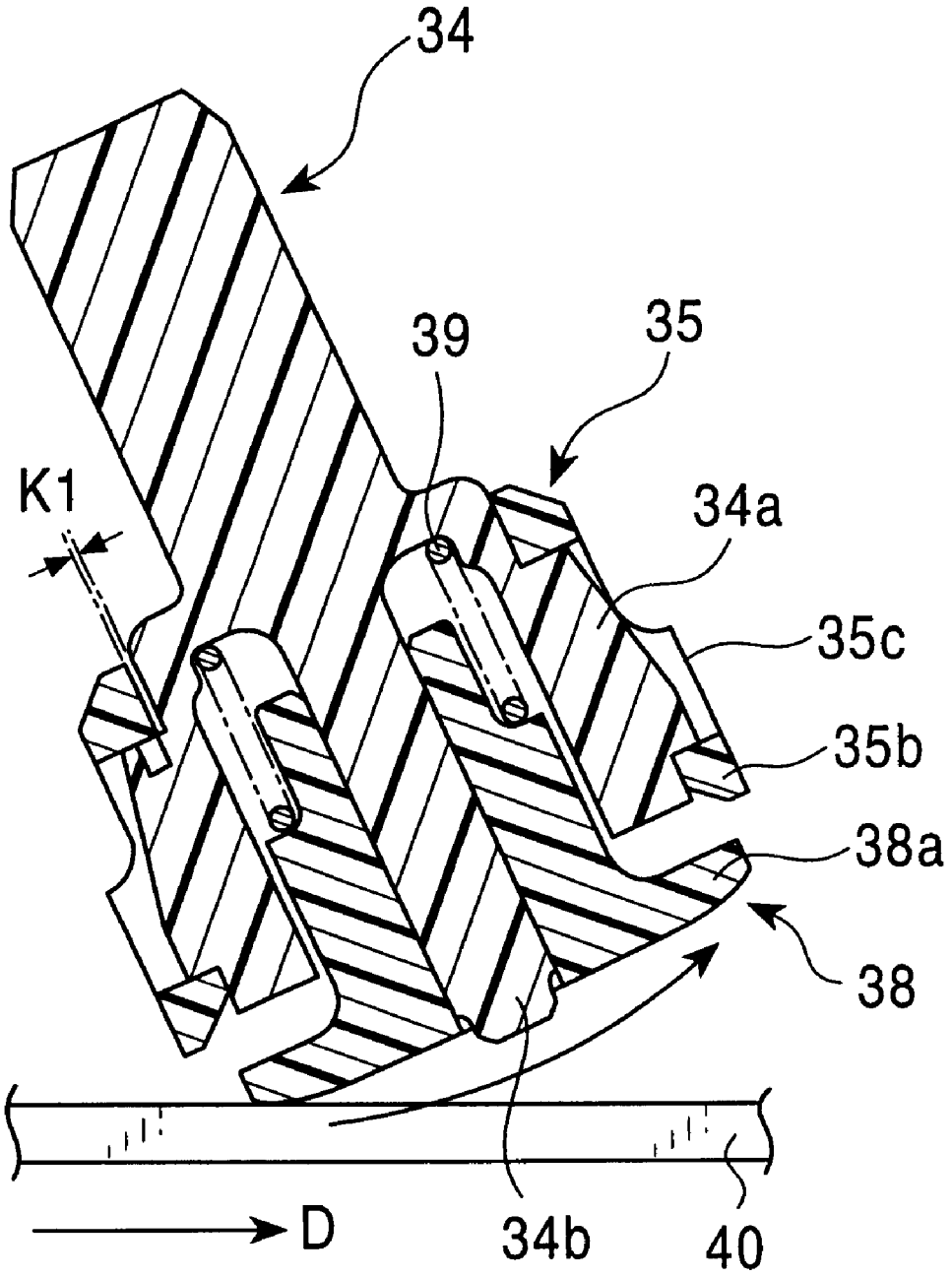
FIG. 20 PRIOR ART
FIG. 20 is an explanatory view showing the operation of the conventional multidirectional input device.

A multidirectional input device according to an embodiment of the present invention will be described below with reference to FIGS. 1 to 13. FIG. 1 is an exploded perspective view of a multidirectional input device according to the present invention, FIGS. 2, 3, 4A and 4B are explanatory views of a second interlock member in the multidirectional input device, FIGS. 5 to 7 are explanatory views of a control shaft in the multidirectional input device, FIG. 8 is a longitudinal sectional view of the principal part of the multidirectional input device, FIG. 9 is a longitudinal sectional view of the multidirectional input device taken along line 9—9 in FIG. 8, FIG. 10 is a sectional view of the principal part of the multidirectional input device taken along line 10—10 in FIG. 8, FIG. 11 is a sectional view of the principal part of the multidirectional input device taken along line 11—11 in FIG. 8, and FIGS. 12 and 13 are explanatory views showing the operation of the multidirectional input device.

Referring to FIG. 1, the multidirectional input device of the present invention is provided with a frame 1 made of an iron plate or the like. The frame 1 includes side plates 1*a*, 1*b*, 1*c*, and 1*d* bent downward by pressing or by other methods, is open at the bottom with a cavity therein, and is outwardly shaped nearly like a rectangular parallelepiped. The top of the frame 1 is covered with an upper plate 1*e* having an operating hole 1*f* at the center.

Side plates 1*a*, 1*c*, and 1*d* (excluding the side plate 1*b*) each have circular holes 1*g*, and the side plates 1*a* and 1*c* also have a plurality of square holes (not shown) for mounting variable resistors 3 serving as rotary electric parts (which will be described below). The side plate 1*b* (opposed to the side plate 1*a*) has a substantially semicircular support portion 1*h* at a position opposed to the circular hole 1*g* of the side plate 1*a*. Part presser bars 1*j* are formed on the right and left sides of the support portion 1*h* so as to be substantially perpendicularly bent outward from the side plate 1*b*.

The opposing side plates 1*c* and 1*d* have, at the bottoms, a plurality of mounting terminals 1*k* extending downward by which the multidirectional input device is mounted on a printed board or the like (not shown).

The side plates 1*a* and 1*b* have, at the bottoms, tongues 1*m* used to mount a bottom plate 8 (which will be described below).

A first interlock member 2 made of a phosphor-bronze plate or the like is placed inside the cavity of the frame 1. The first interlock member 2 is curved upward in an arched form by pressing or by other methods, and the arched portion is provided with a slot 2*a* formed by stamping so as to extend in the longitudinal direction.

Both ends of the first interlock member 2 are bent downward. At one of the bent ends (on the left side in the figure), a pipelike support portion 2*b* is formed by drawing or by other methods, and is fitted in the circular hole 1*g* of the side plate 1*d* so as to be turnably supported thereat.

The other right end of the first interlock member 2 is bent nearly in a U-shape to form a part operating portion 2*c*. The part operating portion 2*c* is protruded outward through a circular hole (not shown) formed in the side plate 1*c* of the frame 1, and is engaged with a horizontal groove of a sliding-element supporting member 3*d* of a variable resistor 3 (which will be described below).

The first interlock member 2 is laid between the circular holes 1*g* of the side plates 1*c* and 1*d* of the frame 1 so that the arched portion is turnably placed inside the frame 1.

Electric parts (for example, variable resistors 3) are mounted, by snap-fitting or by other methods, at the plural square holes (not shown) formed in the side plate 1*a* and the adjoining side plate 1*c* of the frame 1.

In the variable resistor 3 serving as a rotary electric part, as shown in FIG. 8, a substrate 3*b* is formed integrally with a casing 3*a* by insert molding or by other methods and is placed inside the casing 3*a*. A sliding-element supporting member 3*d* with a sliding element 3*c* is turnably mounted on the substrate 3*b* by snap-fitting or by other methods. An operating portion 3*e* having an engagement groove, constituted by a combination of a vertical groove and a horizontal groove, is formed at the turning center of the sliding-element supporting member 3*d*.

The substantially U-shaped part operating portion 2*c* of the first interlock member 2 protruding outward from the circular hole (not shown) of the side plate 1*c* of the frame 1 is engaged with the operating portion 3*e* of the variable resistor 3 mounted on the side plate 1*c*. When the first interlock member 2 turns, the sliding-element supporting member 3*d* of the variable resistor 3 also turns, thereby changing the resistance of the variable resistor 3.

A grip portion 4*a* of a control shaft 4 is passed through the slot 2*a* of the first interlock member 2, and the grip portion 4*a* and a root portion 4*b* are movable along the slot 2*a*. The control shaft 4 is made of synthetic resin or the like, and the grip portion 4*a* and the root portion 4*b* are oval and circular, respectively, as shown in FIGS. 5 to 7. Under the circular root portion 4*b*, a cylindrical portion 4*c* is formed integrally therewith.

The cylindrical portion 4*c* is open at the bottom, is surrounded by an outer wall, and has therein a holding portion 4*d* for holding an urging member 7 formed of a substantially circular return spring (which will be described below). Flat portions 4*e* are formed opposed to each other on the outer wall of the cylindrical portion 4*c*, as shown in FIG. 5. Oval shaft portions 4*f* having a predetermined diameter and a predetermined height project from the flat portions 4*e* in the direction orthogonal to the axial direction of the control shaft 4.

On the lower surface of each of the shaft portions 4*f*, a slope portion 4*j* is formed to be gradually inclined upward from the leading end of the shaft portion 4*f* toward the center of the control shaft 4, as shown in FIG. 7.

A concave grease storing portion 4*k* is formed on the arc-shaped upper surface of the shaft portion 4*f*.

Inside the holding portion 4*d*, a shaft support portion 4*g* is formed integrally with and coaxially with the grip portion 4*a* so as to extend downward in the figure. A bottom end 4*h* of the shaft support portion 4*g* protrudes downward from the cylindrical portion 4*c*.

A plurality of ribs 4*m* extending in the axial direction are formed on the inner wall of the cylindrical portion 4*c* so as to project into the holding portion 4*d*, particularly, as shown in FIG. 11.

On the outer wall of the cylindrical portion 4*c*, projections 4*n* constituting stoppers are formed on the lower sides of the shaft portions 4*f*.

The shaft portions 4*f* are turnably supported by a second interlock member 5, which allows the control shaft 4 to tilt in the directions of the arrow A.

The second interlock member 5 is made of synthetic resin, and is placed below the first interlock member 2 so as to extend in the direction orthogonal to the first interlock member 2.

Figure 2:
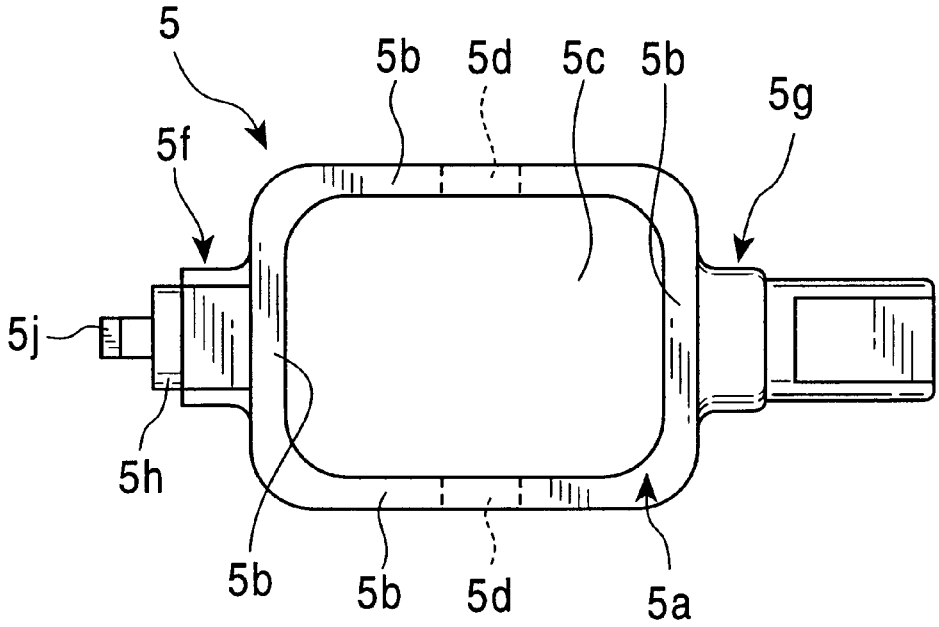
FIG. 2 is a top view of a second interlock member for use in the multidirectional input device of the present invention.
Figure 3:
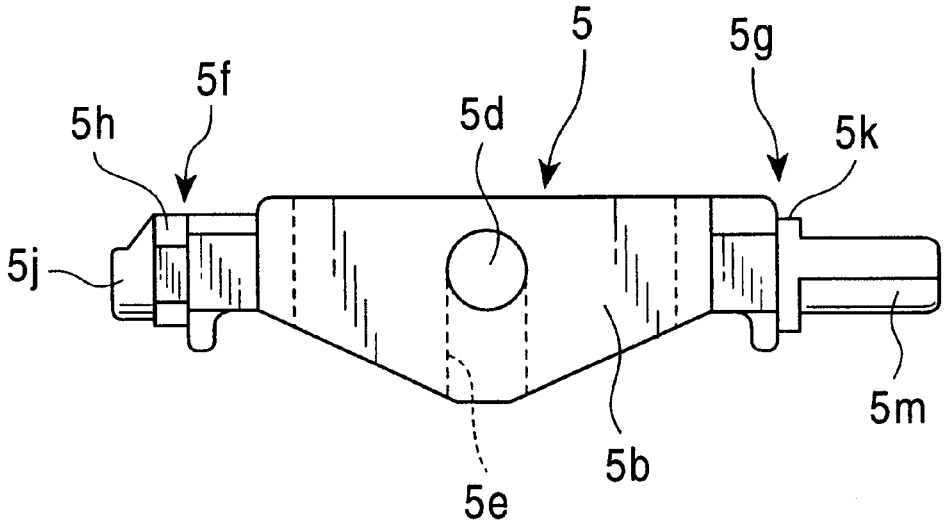
FIG. 3 is a front view of the second interlock member.
Figure 4A:
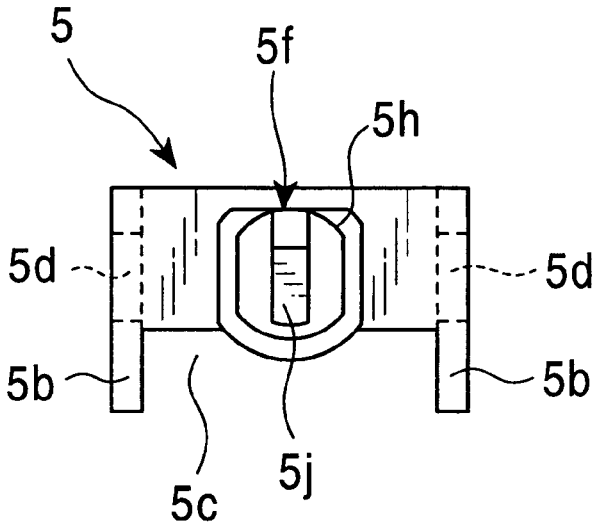
FIGS. 4A and 4B are side views of the second interlock member.
Figure 4B:
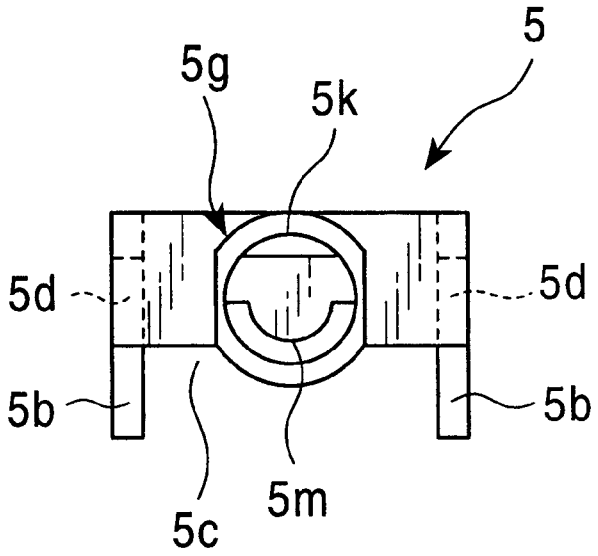

The second interlock member 5 has a support section 5*a*, which is substantially rectangular in outer shape and has a center opening 5*c* at about the center for passing the control shaft 4 therethrough, particularly, as shown in FIGS. 2 to 4. The support section 5*a* comprises side walls 5*b* that are long crosswise and lengthwise, and substantially surrounds the rectangular center opening 5*c*.

Circular holes 5*d* are formed through or as concavities of a predetermined depth, at fixed positions of the side walls 5*b* of the support section 5*a* that are long crosswise, with which the shaft portions 4*f* of the control shaft 4 are engaged. The lower inner faces of the circular holes 5*d* are tapered along the slope portions 4*j* of the shaft portions 4*f*.

On the inner sides of the side walls 5*b*, stopper portions 5*e* are formed of recesses for receiving the projections 4*n* and are disposed below and close to and the circular holes 5*d*, particularly, as shown in FIG. 10.

The shaft portions 4*f* of the control shaft 4 are snapped into the circular holes 5*d*. Thereby, the control shaft 4 is held by the second interlock member 5, and the projections 4*n* abut on the stopper portions 5*e* to constitute stoppers.

After this assembly, the inner sides of the side walls 5*b* are in contact with the flat portions 4*e* on the periphery of the control shaft 4, and the upper and lower portions of the oval shaft portions 4*f* are in contact with the inner faces of the circular holes 5*d*.

First and second arm portions 5*f* and 5*g* horizontally extend from the support section 5*a* to the right and left sides, as shown in FIG. 3. The first arm portion 5*f* extending to one side is provided with a support portion 5*h* having a given diameter, and a platelike part operating portion 5*j* having a given width projects from the support portion 5*h*.

The second arm portion 5*g* extending to the other side is provided with a support portion 5*k* having a given diameter, and a part operating portion 5*m* extends from the support portion 5*k* so as to be flat at the top and to be semicircular at the bottom.

In the second interlock member 5, the support portion 5*h* of the first arm portion 5*f* is fitted in the circular hole 1*g* formed in the side plate 1*a* of the frame 1 and is turnably supported thereat, and the support portion 5*k* of the second arm portion 5*g* is supported at the semicircular support portion 1*h* of the side plate 1*b*. The second interlock member 5 is thereby turnably placed inside the frame 1 to allow the control shaft 4 to be tilted in the direction of the arrow B and so that the part operating portion 5*m* at one end is movable vertically.

The part operating portion 5*j* of the first arm portion 5*f* is engaged with the vertical groove of the operating portion 3*e* of the variable resistor 3 mounted on the side plate 1*a,* and the part operating portion 5*m* of the second arm portion 5*g* is placed on an electric part mounted on the bottom plate 8, for example, a stem portion 9*a* of a pushbutton switch 9 (which will be described below).

At the bottom end 4*h* of the control shaft 4, an operating member 6 is placed to move in the axial direction of the control shaft 4.

The operating member 6 is made of resin, and has, in the lower part, a base portion 6*a* that is circular in outer shape and has a lower surface curved like a saucer. A cylindrical boss portion 6*b* projects upward from the center of the base portion 6*a,* and a shaft hole 6*c* is formed through the center of the boss portion 6*b*.

The boss portion 6*b* of the operating member 6 is provided with a plurality of grooves 6*d* so as to be spline-connected to the ribs 4*m* of the control shaft 4. The base portion 6*a* has a recess 6*e* at the center of the lower surface, and an arc-shaped face portion 6*f* on the periphery of the lower surface.

The shaft support portion 4*g* of the control shaft 4 is passed through the shaft hole 6*c* of the operating member 6, and the boss portion 6*b* is movably fitted in the holding portion 4*d* of the cylindrical portion 4*c*.

In this case, the ribs 4*m* of the control shaft 4 are spline-connected to the grooves 6*d* of the operating member 6, whereby the operating member 6 is allowed to turn with the control shaft 4.

The urging member 7 formed of a coil spring having a predetermined elastic force is placed inside the holding portion 4*d* in the cylindrical portion 4*c* of the control shaft 4 so that the upper and lower coil ends of the urging member 7 are in elastic contact with the ceiling face of the holding portion 4*d* and the upper surface of the boss portion 6*c* of the operating member 6. The urging member 7 is fitted on the shaft support portion 4*g*. One end of the urging member 7 on the side of the grip portion 4*a* is guided by the inner wall of the cylindrical portion 4*c,* and the other end is guided by the outer wall of the boss portion 6*b,* thereby regulating the frontward, rearward, rightward, and leftward movements of the urging member 7.

Below the operating member 6, the bottom plate 8 is placed to close the bottom of the frame 1. The bottom plate 8 is made of resin, is substantially rectangular in outer shape, and is partially provided with side walls 8*a* on the periphery. A flat inner bottom face 8*b* is formed inside the side walls 8*a*.

A conical projection 8*e* shaped like a saucer is formed on the inner bottom face 8*b,* and has a taper portion that gradually rises from the periphery toward the center.

The bottom of the operating member 6 is elastically contacted with the inner bottom face 8*b* by the urging member 7. A part mounting portion 8*c* projects from the side wall 8*a* on one side of the bottom plate 8 so as to mount thereon an electric part, for example, the pushbutton switch 9. A plurality of guide portions 8*d* project from the side walls 8*a* adjoining the side wall 8*a* with the part mounting portion 8*c* so as to position the bottom ends of the side plates 1*c* and 1*d* of the frame 1.

The pushbutton switch 9 to be mounted on the part mounting portion 8*c* comprises the stem portion 9*a* for opening and closing an inner switch circuit (not shown), a casing 9*b* for hermetically sealing the switch circuit, and a plurality of mounting terminals 9*c* extending downward from the side faces of the casing 9*b*. In such a pushbutton switch 9, the mounting terminals 9*c* can be temporarily fixed to the part mounting portion 8*c* of the bottom plate 8 by snap-fitting or by other means.

In order to assemble the above-described multidirectional input device of the present invention, first, the arched first interlock member 2 is inserted into the frame 1 from the open bottom side, the part operating portion 2*c* is inserted in the circular hole (not shown) of the side wall 1*c,* and the support portion 2*b* is inserted in the circular hole 1*g* of the side wall 1*d,* whereby the first interlock member 2 is placed inside the frame 1.

Next, the cylindrical portion 4*c* of the control shaft 4 is placed in the center opening 5*c* of the second interlock member 5, and the oval shaft portions 4*f* are placed on the side walls 5*b*.

When the control shaft 4 is pressed into the center opening 5*c* by a jig (not shown), the side walls 5*b* are elastically deformed and are stretched outward, and the shaft portions 4*f* are snap-fitted in the circular holes 5*d* formed in the side walls 5*b*. The control shaft 4 is thereby turnably supported by the second interlock member 5.

Next, grease is injected into grease storing portions 10 (see FIG. 10), formed by spaces formed between linear portions on both sides of the oval shaft portions 4*f* and the circular holes 5*d,* in order to prevent problems, such as jarring, in a sliding portion between the control shaft 4 and the second interlock member 5. Moreover, grease also spreads and is stored in the grease storing portions 4*k* of the control shaft 4, thereby preventing problems such as jarring.

Subsequently, the grip portion 4*a* of the control shaft 4 turnably supported by the second interlock member 5 is passed through the slot 2*a* of the first interlock member 2, and is protruded outward from the operating hole 1*f* of the frame 1 so that the circular root portion 4*b* is placed at the slot 2*a*.

The support portion 5*h* of the first arm portion 5*f* of the second interlock member 5 is inserted in the circular hole 1*g* of the side plate 1*a* of the frame 1, the part operating portion 5*j* at the leading end is protruded outward from the side plate 1*a,* and the support portion 5*k* of the second arm portion 5*g* is placed at the support portion 1*h* of the side plate 1*b* of the frame 1.

The frame 1, in which the first and second interlock members 2 and 5 are laid, is inverted so that the open bottom side points upward. The urging member 7 is inserted and held in the holding portion 4*d* of the cylindrical portion 4*c* of the inverted control shaft 4.

When the shaft hole 6*c* of the operating member 6 is fitted on the shaft support portion 4*g* of the control shaft 4, the boss portion 6*b* of the operating member 6 is spline-connected to the interior of the cylindrical portion 4*c* of the control shaft 4, is movably fitted therein, and is elastically contacted with the urging member 7.

The bottom plate 8, in which the pushbutton switch 9 is temporarily mounted on the part mounting portion 8*c,* is inverted and placed on the inverted frame 1. Then, the bottom plate 8 is positioned on the frame 1 with the end of the side plate 1*c* guided by the guide portions 8*d,* and the part presser bars 1*j* of the side plate 1*b* are placed on the upper surface of the casing 9 of the pushbutton switch 9, whereby the pushbutton switch 9 is fixed on the bottom plate 8.

By caulking the plural tongues 1*m* formed in the side plates 1*a* and 1*b* of the frame 1, the bottom plate 8 is fixedly combined with the frame 1, the bottom of the operating member 6 is elastically contacted with the inner bottom face 8*b* of the bottom plate 8, and the control shaft 4 is placed into the neutral upright position, as show in FIGS. 8, 9, and 12.

The operating portion 3*e* of the variable resistor 3 is engaged with the part operating portion 5*j* of the second interlock member 5 that protrudes outward from the circular hole 1*g* of the side plate 1*a,* and the variable resistor 3 is snap-fitted in the plural square holes (not shown) formed in the side plate 1*a,* whereby the variable resistor 3 is retained by the side plate 1*a.*

Furthermore, the operating portion 3*e* of the variable resistor 3 is similarly engaged with the part operating portion 2*c* of the first interlock member 2 protruding outward from the side plate 1*c,* and the variable resistor 3 is retained by the side plate 1*c.* Assembling of the multidirectional input device of the present invention is then completed.

While the electric parts formed of the variable resistors 3 are mounted on the frame 1 after the first and second interlock members 2 and 5 are mounted in the frame 1 in the above-described assembly operation, the variable resistors 3 may be mounted on the discrete frame 1 before the first and second interlock members 2 and 5 are mounted therein.

Description will now be given of the operation of the multidirectional input device of the present invention. When an operating force is not applied to the grip portion 4*a* of the control shaft 4 (i.e., when no load is imposed), the operating member 6 is elastically contacted with the inner bottom face 8*b* of the bottom plate 8 by elastic force of the urging member 7, the saucerlike bottom face of the base portion 6*a* is in the horizontal position, and the control shaft 4 is in the neutral upright position, as shown in FIGS. 8 and 12. In this neutral state, the projection 8*e* of the bottom plate 8 is placed inside the recess 6*e* of the operating member 6.

When the control shaft 4 in this neutral position is tilted along the slit 2*a* of the first interlock member 2 in the direction B—B in FIGS. 8 and 12, the second interlock member 5 is turned on the support portions 5*h* and 5*k* of the first and second arm portions 5*f* and 5*g,* the bottom face of the base portion 6*a* in the operating member 6 moves in sliding contact with the inner bottom face 8*b* of the bottom plate 8, as shown in FIG. 13, and the operating member 6 tilts while the arc-shaped face portion 6*f* on the lower periphery of the base portion 6*a* contacts the taper portion of the projection 8*e* of the bottom plate 8.

The boss portion 6*b* of the operating member 6 is pressed into the holding portion 4*d* of the cylindrical portion 4*c* of the control shaft 4 against the elastic force of the urging member 7.

In this case, in the neutral state shown in FIG. 12, clearances K1 and K2 (serving as play) are formed on the right and left sides of the control shaft 4 between the control shaft 4 and the second interlock member 5 because of the connection structure therebetween.

When the control shaft 4 is initially tilted, the clearance K1 on the tilting side is lost, and the clearance K2 on the opposite side increases.

When the tilting operation is continued, the arc-shaped face portion 6*f* of the operating member 6 slides while running on the taper portion of the projection 8*e,* which regulates the movement of the operating member 6. For this reason, even when the operating member 6 is tilted by a given angle, the arc-shaped face portion 6*f* does not slip on the bottom plate 8 in the direction of the arrow D in FIG. 13. This allows the tilting operation to be performed while the state of the clearance K2 is maintained.

When the second interlock member 5 is turned, the sliding-element supporting member 3*d* of the variable resistor 3 engaged with the part operating portion 5*j* of the first arm portion 5*f* is turned to change the resistance.

When the control shaft 4 is tilted in the direction of the arrow B, it contacts the end of the slit 2*a* of the first interlock member 2, and stops the tilting operation.

When the operating force applied to the control shaft 4 is removed, the operating member 6 automatically returns to the horizontal state because of the elastic force of the urging member 7, and the control shaft 4 automatically returns to the neutral upright position.

In contrast, when the control shaft 4 is tilted along the center opening 5*c* of the second interlock member 5 in the direction A—A in FIG. 9, the first interlock member 2 turns on the support portion 2*b* and the part operating portion 2*c*.

When the first interlock member 2 turns, the sliding-element supporting member 3*d* of the variable resistor 3 mounted on the side plate 1*c* and engaged with the part operating portion 2*c* is turned, thereby changing the resistance of the variable resistor 3. The operation of the operating member 6 in this case is the same as the above-described operation when the control shaft 4 is tilted in the direction B—B, and therefore the description thereof has been omitted.

When the control shaft 4 is tilted in the direction of the arrow A, the projections 4*n* move in the recesses and abut on the stopper portions 5*e,* which thereby constitute stoppers.

The control shaft 4 can be tilted throughout a range of 360°. The control shaft 4 in the tilted state can also be turned in the direction of the arrow E in FIG. 1. In this case, the operating member 6 spline-connected to the control shaft 4 turns together, and the bottom of the base portion 6*a* of the operating member 6 turns in a rolling manner without slipping on the bottom plate 8 even when there is friction therebetween due to elastic pressing by the urging member 7.

Description will now be given of the operation of the pushbutton switch 9 serving as an electric part in addition to the variable resistors 3. First, the control shaft 4 is pressed down in the direction of the arrow C (see FIG. 8). Pressing force is thereby applied to the circular holes 5*d* of the second interlock member 5, and the second arm portion 5*g* turns downward on the support portion 5*h* of the first arm portion 5*f.*

Then, the part operating portion 5*m* of the second arm portion 5*g* protruding outward from the support portion 1*h* of the side plate 1*b* moves vertically, and presses the stem portion 9*a* of the pushbutton switch 9 to turn the pushbutton switch 9 on and off.

The control shaft 4 may be pressed in the direction of the arrow C not only in the neutral position, but also when it is tilted to control the resistance of the variable resistor 3.

While the shaft portions 4*f* of the control shaft 4 are formed of oval projections and the second interlock member 5 has the circular holes 5*d* in the above description of the embodiment, the shaft portions 4 may be recessed and the circular holes 5*d* may be replaced with projections.

While both the control shaft 4 and the second interlock member 5 are made of an elastically deformable resin material or the like, one of the control shaft 4 and the second interlock member 5 may be made of metal by die-casting.

While the variable resistors 3 and the pushbutton switch 9 are adopted as the plural electric parts, they may be replaced with rotary electric parts, such as an encoder, or electric parts to be operated by pushing.

While the cylindrical portion 4*c* of the control shaft 4 is open at the bottom and is surrounded by the outer wall, a part of the outer wall excluding the portions having the shaft portions 4*f* may be open. In this case, the shaft portions 4*f* are more likely to be elastically deformed, which improves workability in snap-fitting.

While the projection 8*e* of the bottom plate 8 is conical, it may have at least a tapered portion in the direction in which the control shaft 4 is turnably supported by the second interlock member 5, that is, in the first interlock member forming direction. This prevents the tactile feel in tilting the control shaft 4 due to the clearances K1 and K2 existing in the turnable support direction.

The inner wall of the shaft hole 6*c* of the operating member 6 and the outer wall of the shaft support portion 4*g* of the control shaft 4 may be spline-connected.

The grease storing portions 4*k* and the like may be provided in a sliding portion between the control shaft 4 and the first or second interlock member 2 or 5 in order to prevent jarring or the like.

The stopper portions 5*e* formed of recesses for receiving the projections 4*n* of the control shaft 4 may be provided at appropriate positions in the second interlock member 5.

According to the multidirectional input device of the present invention, the surface of the bottom plate 8 facing the bottom of the operating member 6 is provided with the projection 8*e* having a taper portion that gradually rises from the outer periphery toward the center, and the operating member 6 tilted with the tilting operation of the control shaft 4 contacts the projection 8*e* to regulate the motion of the operating member 6. Therefore, the operating member 6 does not slip, which differs from the conventional art, and this makes it possible to provide a multidirectional input device with a good operability in which a tactile feel is not produced in the tilting operation.

The control shaft 4 is turnably supported by the first or second interlock member 2 or 5 in the direction orthogonal to the axial direction, and the projection 8*e* has at least a taper portion in the support direction. Therefore, the operating member 6 can be prevented from slipping due to the clearances K1 and K2 between the control shaft 4 and the first or second interlock member 2 or 5. This makes it possible to provide a multidirectional input device with a good operability.

Since the taper portion of the projection 8*e* is conical, the operating member 6 is prevented from slipping in the operation of tilting the control shaft 4 throughout a range of 360°, which provides a multidirectional input device with a good operability.

The operating member 6 has a recess 6*e* on the surface facing the bottom plate 8, and the projection 8*e* is placed in the recess 6*e*. This makes it possible to provide a compact multidirectional input device that shows a high space factor.

The operating member 6 has an arc-shaped face portion 6*f* on the outer periphery facing the bottom plate 8, and the arc-shaped face portion 6*f* is in contact with the taper portion of the projection 8*e*. This makes it possible to provide a multidirectional input device in which the operating member 6 smoothly moves and smoothly runs onto the taper portion, and the manipulation feeling is preferable.

While the present invention has been described with reference to what are presently considered to be the preferred embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. A multidirectional input device comprising:

a frame;

first and second interlock members turnably mounted in said frame so as to intersect each other;

a control shaft having an axial direction positioned perpendicularly to said first and second interlock members when said control shaft is in a neutral position, said control shaft being held by said second interlock member in a manner that permits said first and second interlock members to be turned by a tilting operation of the control shaft;

a bottom plate placed so as to intersect the axial direction of said control shaft;

an operating member held by said control shaft and movable in the axial direction of said control shaft;

an urging member for elastically pressing a bottom surface of said operating member against an upper surface of said bottom plate; and electric parts operated via said first and second interlock members by the tilting operation of said control shaft, wherein the upper surface of said bottom plate facing the bottom of said operating member is provided with an upwardly facing projection having a tapered portion that gradually rises from the outer periphery of the projection toward the center of the projection, said center of the projection generally intersecting the axial direction of said control shaft when said control shaft is in the neutral position, and wherein the tilting operation of said control shaft causes the bottom surface of the operating member to slidably engage the tapered portion of said projection so as to regulate the motion of said operating member.

2. A multidirectional input device according to claim 1, wherein the tapered portion of said projection is disposed in a direction that is parallel with said first interlock member.

3. A multidirectional input device according to claim 1, wherein said tapered portion of said projection is conical in shape.

4. A multidirectional input device according to claim 1, wherein the bottom surface of said operating member comprises a recess facing the upper surface of said bottom plate, and said projection is disposed within said recess when said control shaft is in the neutral position.

5. A multidirectional input device according to claim 1, wherein the bottom surface of said operating member comprises an arc-shaped face portion on an outer periphery facing the upper surface of said bottom plate, and said arc-shaped face portion is in contact with said tapered portion of said projection during the tilting operation of said control shaft.

* * * * *